US007422249B2

(12) United States Patent
Glover

(10) Patent No.: US 7,422,249 B2
(45) Date of Patent: Sep. 9, 2008

(54) GLIDING DOOR, LATCH MECHANISM AND METHOD

(76) Inventor: J. Raymond Glover, 1401 Euclid Ave., Medford, OR (US) 97504

( * ) Notice: Subject to any disclaimer, the term of this patent is extended or adjusted under 35 U.S.C. 154(b) by 554 days.

(21) Appl. No.: 10/027,252

(22) Filed: Dec. 21, 2001

(65) Prior Publication Data

US 2004/0212198 A1 Oct. 28, 2004

Related U.S. Application Data

(60) Provisional application No. 60/257,400, filed on Dec. 22, 2000.

(51) Int. Cl.
*E05C 3/06* (2006.01)

(52) U.S. Cl. ..... 292/199; 292/DIG. 46; 292/DIG. 72

(58) Field of Classification Search ..... 292/199, 292/DIG. 72, DIG. 46; 49/287, 293, 276, 49/277
See application file for complete search history.

(56) References Cited

U.S. PATENT DOCUMENTS

| | | | | | |
|---|---|---|---|---|---|
| 1,625,941 | A | * | 4/1927 | Hoffenberg | 49/277 |
| 1,946,714 | A | * | 2/1934 | Shafer | 49/277 |
| 2,210,229 | A | * | 8/1940 | Boerner | 292/172 |
| 2,926,399 | A | * | 3/1960 | Ramunas | 49/248 |
| 3,947,999 | A | | 4/1976 | Disperens | |
| 4,064,593 | A | | 12/1977 | Helmick | |
| 4,457,046 | A | | 7/1984 | Vater | |
| 4,461,597 | A | * | 7/1984 | Laurin | 404/25 |
| 4,577,577 | A | | 3/1986 | Eriksson | |
| 4,619,075 | A | | 10/1986 | Wiles | |
| 4,624,074 | A | | 11/1986 | Shuttleworth | |
| 4,641,461 | A | | 2/1987 | Niekrasz et al. | |
| 4,641,462 | A | | 2/1987 | Markus | |
| 4,651,469 | A | | 3/1987 | Ngian et al. | |
| 4,656,781 | A | | 4/1987 | Niekrasz et al. | |
| 4,662,110 | A | | 5/1987 | Rokicki | |
| 4,680,828 | A | | 7/1987 | Cook et al. | |
| 4,691,474 | A | | 9/1987 | Rokicki | |
| 4,726,145 | A | | 2/1988 | Rokicki | |
| 4,759,575 | A | | 7/1988 | McKnight | |
| 4,891,921 | A | | 1/1990 | Governale | |
| 4,893,435 | A | | 1/1990 | Shalit | |
| 4,987,638 | A | | 1/1991 | Ribaudo | |
| 5,193,431 | A | | 3/1993 | Propsting et al. | |
| 5,209,018 | A | | 5/1993 | Heinrich | |
| 5,301,468 | A | | 4/1994 | Kamezaki | |
| 5,313,739 | A | | 5/1994 | Nelson et al. | |
| 5,421,627 | A | | 6/1995 | Yane | |
| 5,566,505 | A | | 10/1996 | Kamezaki | |
| 5,595,409 | A | | 1/1997 | Fier et al. | |
| 5,653,483 | A | | 8/1997 | Grover | |
| 5,671,502 | A | | 9/1997 | Ezman | |
| 5,791,089 | A | | 8/1998 | Prevot et al. | |

(Continued)

*Primary Examiner*—Gary Estremsky
(74) *Attorney, Agent, or Firm*—patenttm.us

(57) ABSTRACT

A gliding door system employs a latch with a gear and pinion mechanism for smooth opening of a door. A lower door push member is driven with the opening of the latch, so as to urge the door open by pushing at a lower end thereof. The door suitably is carried by adjustable wheels that ride on a rail like member, wherein at a closed position, the rail is slightly depressed, to lower the door slightly at the closed position, to bring lower seals into engagement with seats. The push member assists in urging the wheel out of the depressed portion.

8 Claims, 13 Drawing Sheets

U.S. PATENT DOCUMENTS 5,816,629 A 10/1998 Donald
5,820,170 A 10/1998 Clancy
5,839,228 A 11/1998 Duffy
5,870,859 A 2/1999 Kitada
5,906,403 A 5/1999 Bestler et al.
5,918,915 A 7/1999 Calteux
5,921,612 A 7/1999 Mizuki et al.
5,951,068 A 9/1999 Strong et al.
5,979,949 A 11/1999 Finkelstein et al.
5,979,950 A 11/1999 Prevot et al.
D417,831 S 12/1999 Libby et al.
6,000,734 A 12/1999 Prevot et al.
6,007,113 A 12/1999 Prevot et al.

* cited by examiner

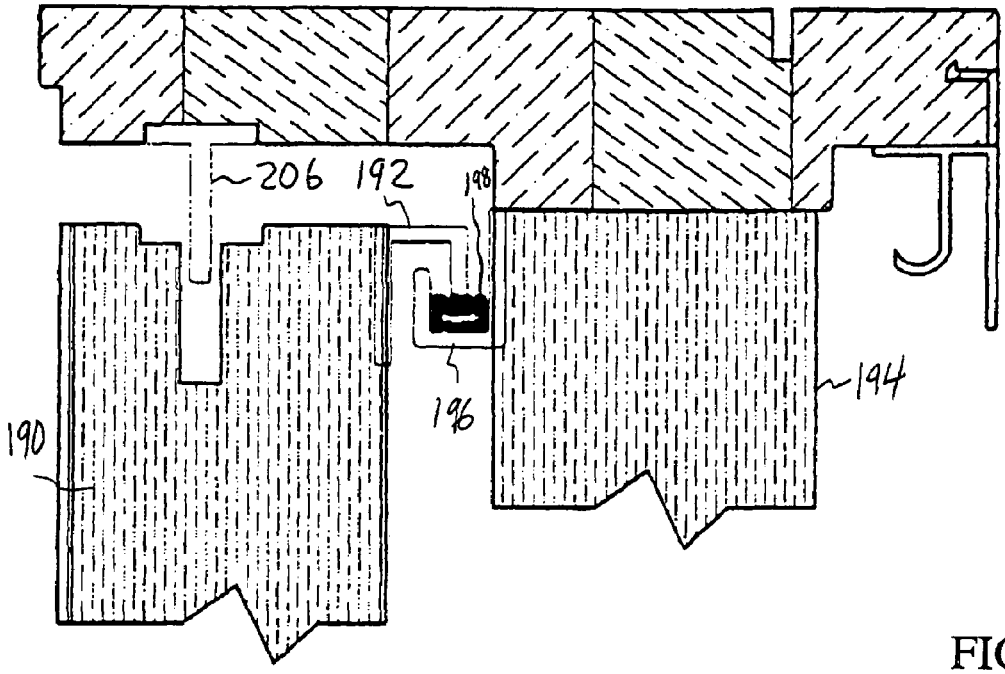
FIG. 13
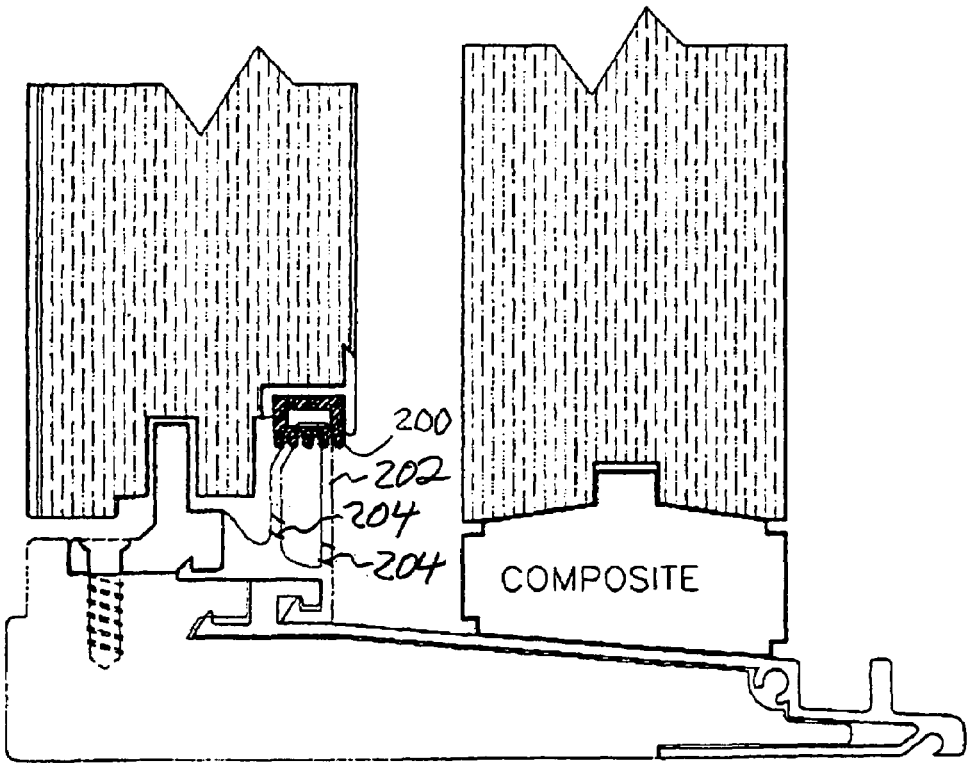

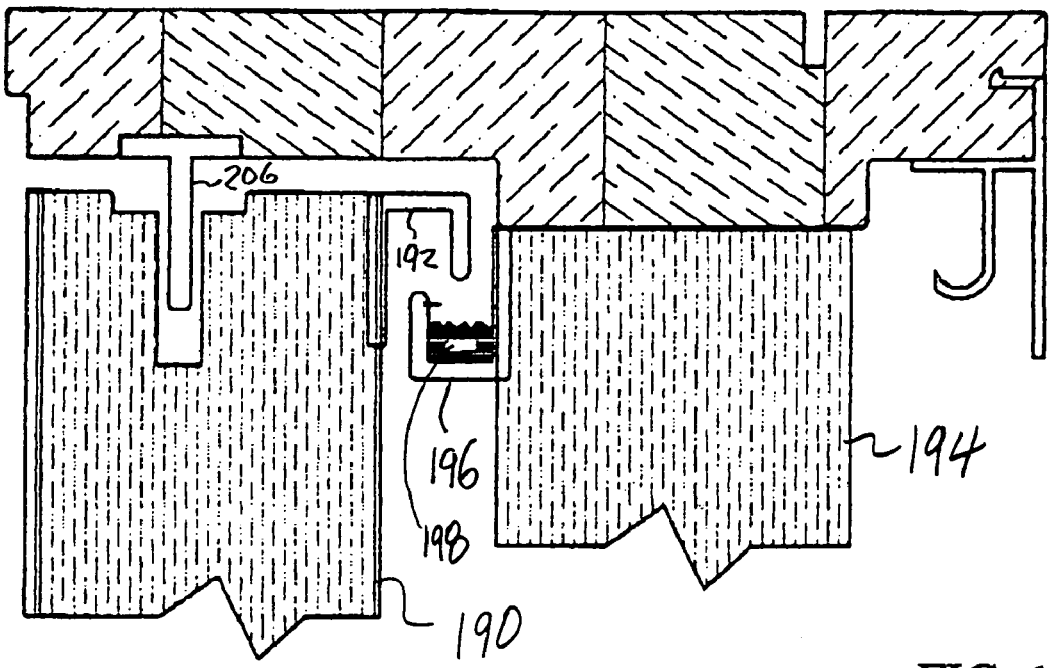
FIG. 14
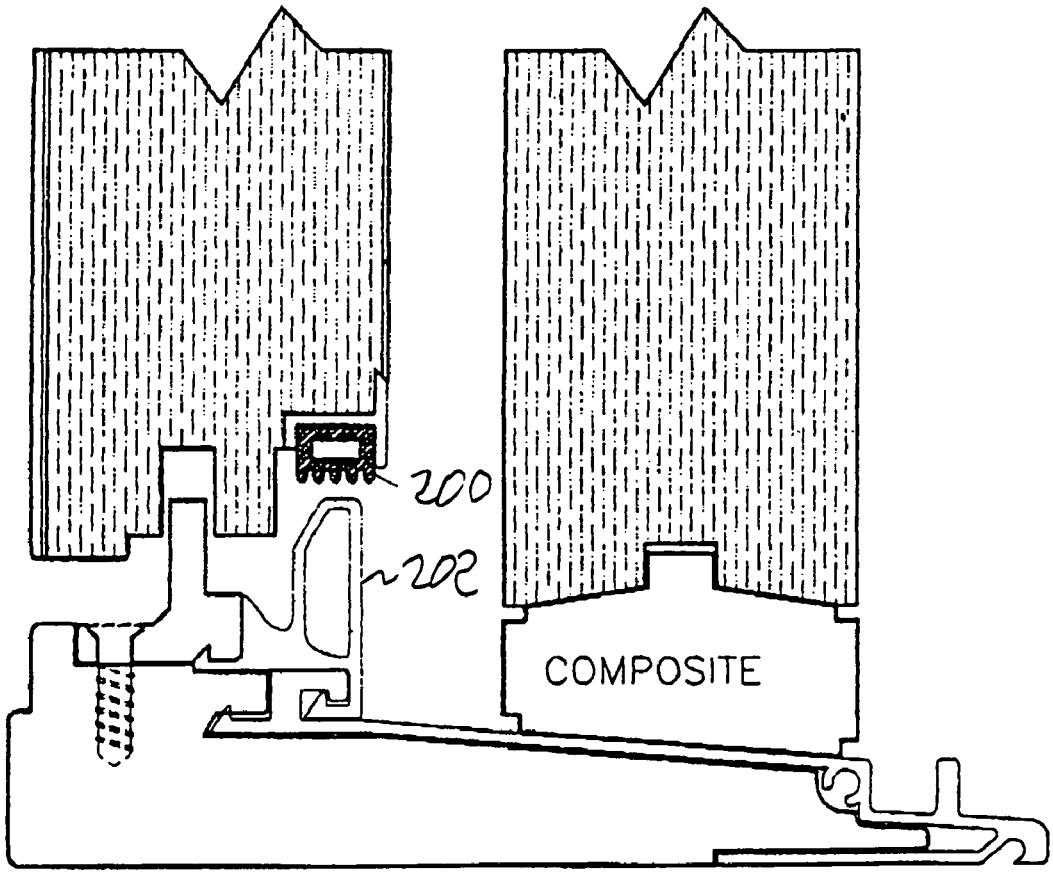

GLIDING DOOR, LATCH MECHANISM AND METHOD

BACKGROUND OF THE INVENTION

This invention relates to sliding doors, and more particularly to door seals and latch mechanisms for gliding doors.

Referring to FIG. 1, a schematic view of a wood frame sliding door in accordance with the prior art, a sliding door includes left and right wood stiles 10, and wood rails 12 therebetween, defining the frame of the door. Wheels or rollers 14 are positioned near the outer edges of the rails, and the wheel supports are secured to the rails via screws 20. Typically, the width 18 of the stiles is 3.5 inches, and, in the illustrated example, the overall width 22 of the door is about 3 feet. A downwardly pivoting handle 16 is provided, and when actuated, pivots in the direction of arrow 24. However, the handle is considered by many to be too large in proportion to the door. Also, for doors of approximately three feet in width, when a person is attempting to open the door by use of the handle, the door will want to tip or pivot on the wheels, leading to binding. This tipping/binding typically occurs unless the doors are 48 inches or wider.

Heretofore, for wood frame doors, it was difficult to overcome these problems. The wheels or rollers 14 could not be securely mounted to the stiles, as the orientation of the grain of the stile runs vertically, and moving the rollers outwardly towards the edges of the door would result in the fastening screws 20 being driving parallel to the grain of the stile, which would not provide sufficient engaging, ultimately leading to the wheels loosening from their engagement with the door.

Another issue that arises is that the door will desirably have seals along the bottom thereof (at least) in order to prevent drafts when the door is closed. However, the seals make it difficult to open the door as a result of friction from the seals dragging, and, the continued dragging of the seals over multiple open/close cycles of the door results in excessive wear or ultimate failure of the seals, as well as making the sliding of the door not as easy.

SUMMARY OF THE INVENTION

In accordance with the invention, a gliding door latch system includes rack and pinion drive gears for smooth opening of a door. A lower door push member is driven with the opening of the latch, so as to urge the door open by pushing at a lower end thereof. The door suitably is carried by wheels that ride on a rail like member, wherein at a closed position, the rail is slightly depressed, to lower the door slightly at the closed position, to bring lower seals into engagement with seats.

Accordingly, it is an object of the present invention to provide an improved gliding door latch.

It is a further object of the present invention to provide an improved gliding door mechanism that enables easy opening of a gliding door without binding thereof.

It is yet another object of the present invention to provide an improved gliding door latch that enables easy opening of the door without requiring an excessively large handle.

A further object of the invention is to provide an improved gliding door system that is easy to open and glide, while still enabling desired weather sealing.

Another object of the invention is to provide an improved wheel mechanism for use in a gliding door.

It is still a further object of the invention to provide an improved wheel structure for a gliding door that enables placement of the wheels near the outer edges of the door.

It is yet another object of the invention to provide an improved mounting structure for securing the door wheels to both the stile and rail of the door for improved engagement thereof.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

BRIEF DESCRIPTION OF THE DRAWINGS

FIG. 13 is a sectional view of a gliding door illustrating a preferred seal embodiment, with the door in a closed position;

FIG. 14 is a sectional view of the gliding door of FIG. 13, with the door in the open position, illustrating a preferred seal;

DETAILED DESCRIPTION

The system according to a preferred embodiment of the present invention comprises a door latch mechanism and door wheel system.

Figure 1:
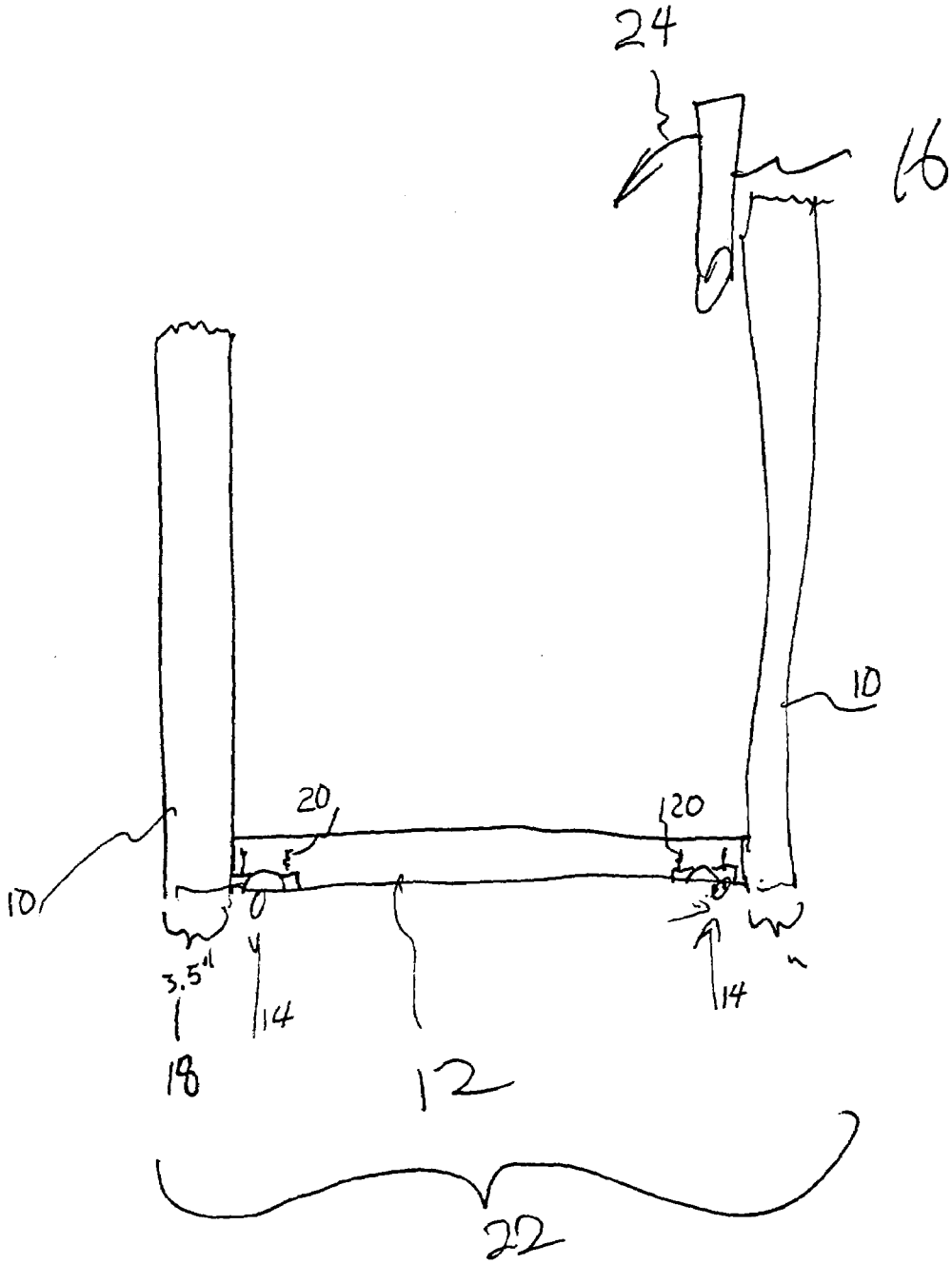
FIG. 1 PRIOR ART
FIG. 1 is a schematic view of a sliding door according to the prior art.
Figure 2:
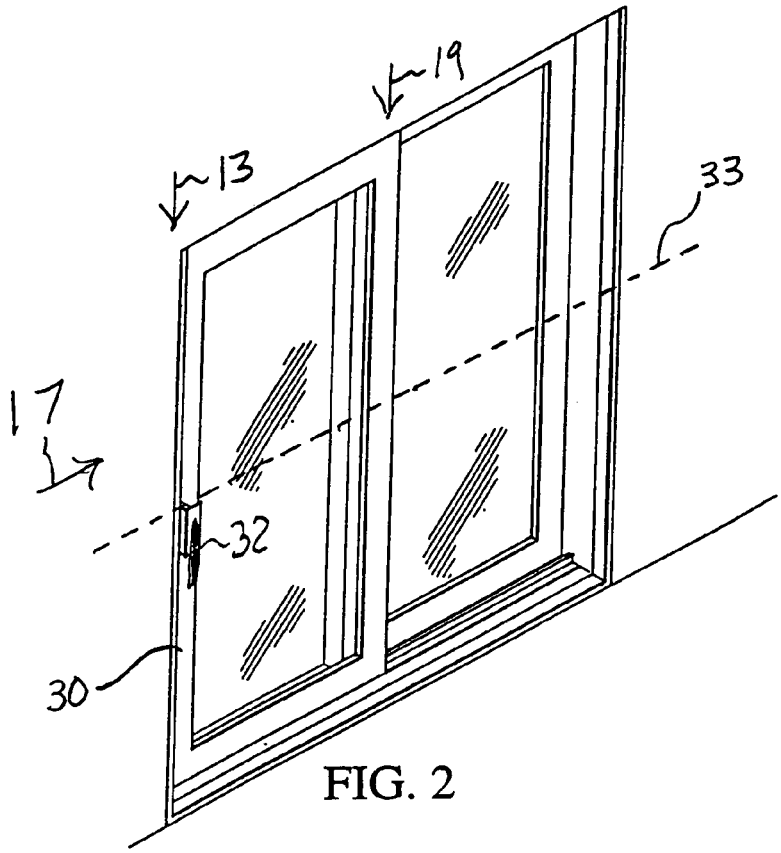
FIG. 2 is a perspective view of a gliding door latch according to the invention as installed on a gliding door, when the door is closed.
Figure 3:
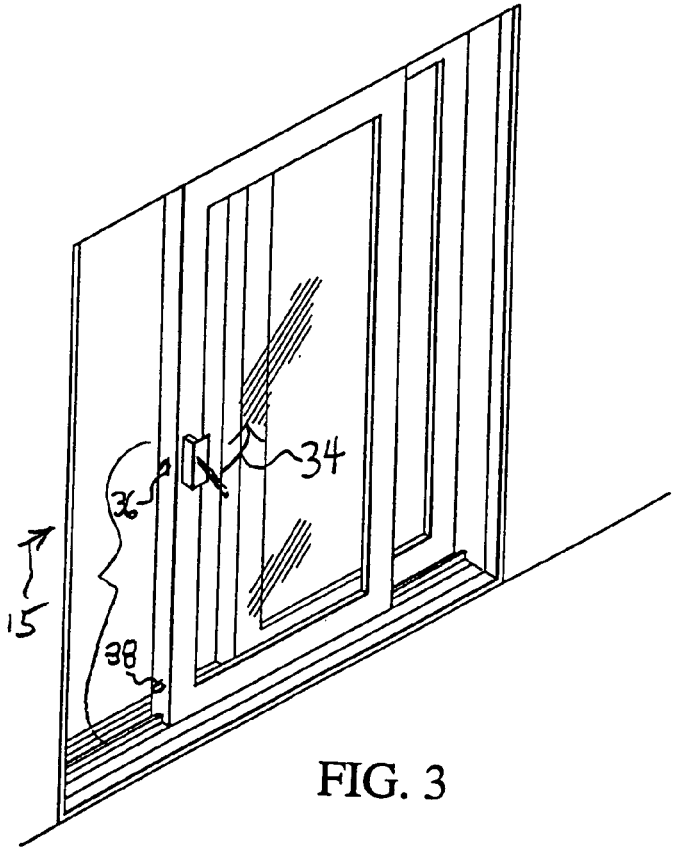
FIG. 3 is a perspective view of a gliding door latch according to the invention as installed on a gliding door, when the door is open.

Referring now to FIG. 2 and FIG. 3 together, which comprise perspective views of a gliding door latch according to the invention as installed on a gliding door, when the door is closed and open, respectively, the door 30 is provided with a pivoting handle 32, the handle suitably being mounted below the vertical mid-height line 33 of the door. The door is opened by pivoting the handle upwardly in the direction of arc 34 (FIG. 3), which causes release of a latch 36 (which operated to keep the door latched closed until the handle was actuated) and which further causes a push member 38, positioned near the bottom of the door frame, to extend, to assist in urging the door open.

Figure 4:
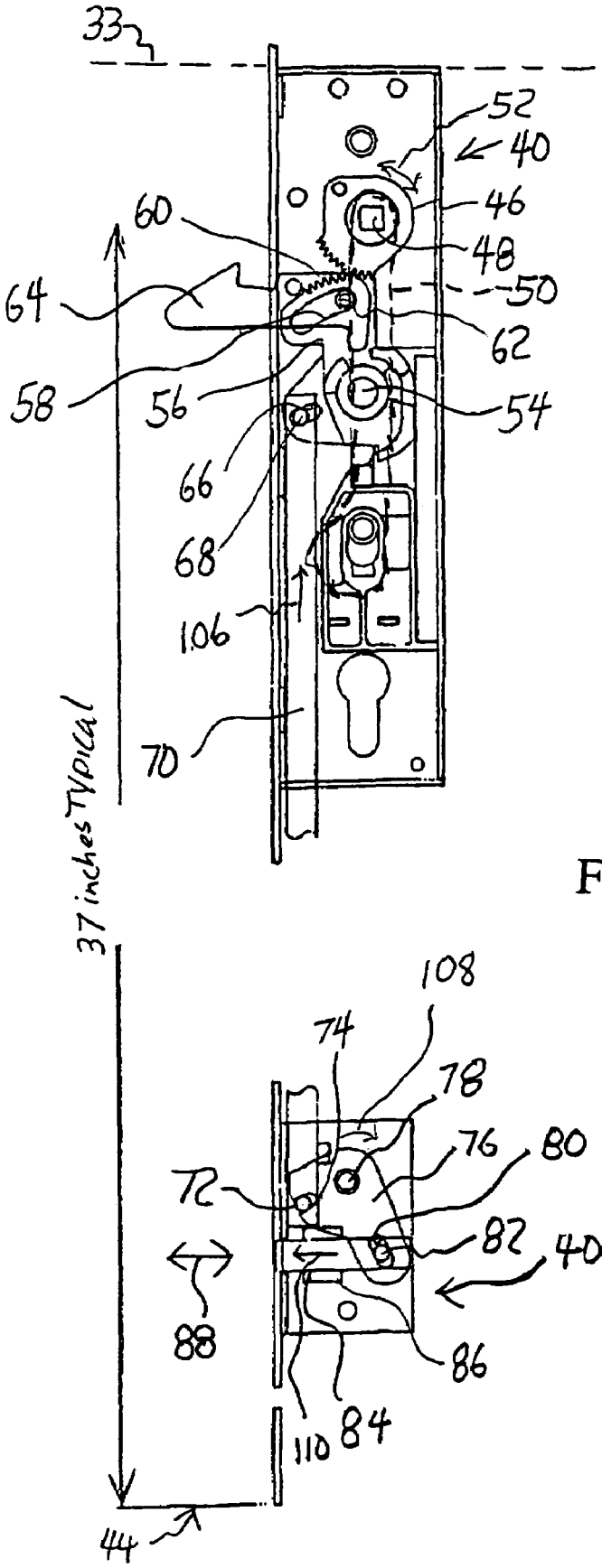
FIG. 4 is a cut away view of operative components of the gliding door latch according to the invention.

Referring to FIG. 4, which is a cut away view of operative components of the gliding door latch, the latch mechanism includes an upper set of operative components 40 and a lower set of operative components 42, with the upper components positioned below the vertical centerline 33 of the door, and the lower set of components positioned somewhat above the bottom 44 of the door. Both sets 40 and 42 of components are suitably mounted within the door so as to be flush with the edge of the door.

A first partial gear pinion member 46 is rotationally carried by a shaft 48, which also carries handle 50 (illustrated in phantom in FIG. 4) thereon. By movement of the handle, the partial gear pinion member rotates with the shaft as noted by arc 52. A second partial gear member 56 is rotationally mounted about pivot shaft 54 below the first gear pinion member 46, and carries gear teeth 60 thereon which suitably mate with the gear teeth of member 46.

Second member 56 includes an arcuate slot 58, which holds a pin 62 therein for movement of the pin along the slot. The pin is mounted to a latch member 64, the latch member extending outwardly of the vertical edge of the door, suitably for engagement with a corresponding portion of a frame, for latching the door shut.

Somewhat below pivot shaft 54, the second member 56 has a pin receiving slot 66, which attaches by pin 68 to an elongate actuator bar 70. Actuator bar 70 extends downwardly from the slot 66, to the lower set of components 42. There, a pin 72 held in the lower end of the actuator bar engages a slot 74 in a cam 76, said cam being pivotally mounted to a shaft 78. An opposite and lower end of the cam has a slightly elongate slot 80 therein which receives a pin 82, the pin 82 attaching actuator bar 84 at a rearward end thereof, to the cam. Actuator bar 84 is slidingly held by mount 86 to enable movement of the actuator bar inwardly and outwardly of the door along axis 88.

Figure 6:
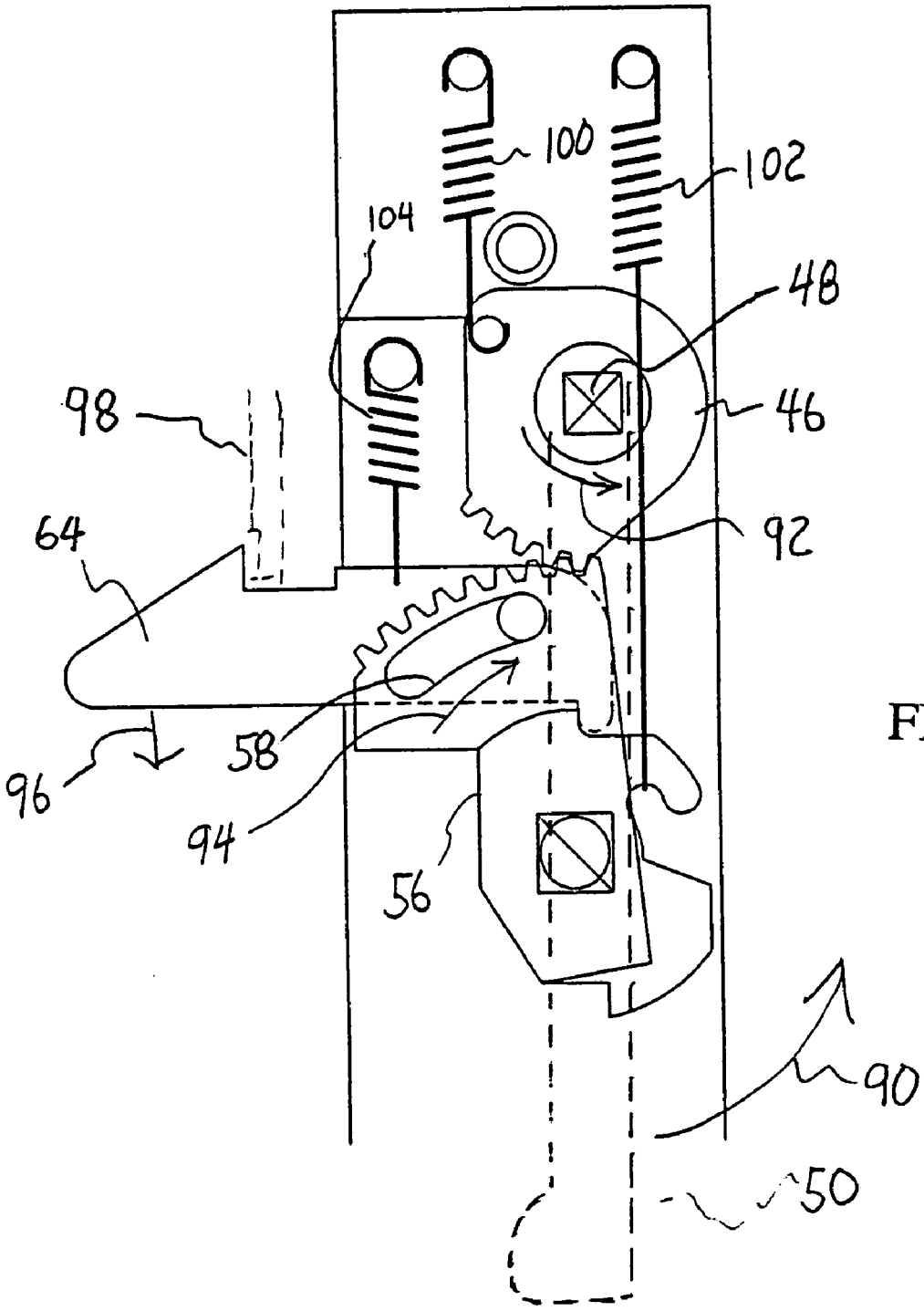
FIG. 6 is a more enlarged schematic view of principle portions of the upper operative components of the gliding door latch according to the invention.

Referring now to FIG. 6, a more enlarged schematic view of principle portions of the upper operative components of the gliding door latch, together with FIG. 4, in operation, when the door is to be opened, handle 90 is rotated upwardly along the direction of arc 90, which causes first partial gear pinion member 46 to rotate in the direction of arc 92 about shaft 48. The gear teeth of pinion member 46 engage teeth 60 of second partial gear member 56, causing it to rotate along arc 94 about its shaft 54. Pin 62 rides in slot 58, and as a result of the attachment of the pin to latch member 64, latch 64 will move downwardly in the direction of arrow 96, suitably disengaging from its corresponding engagement member 98 (typically in the frame of an opening), enabling the door to slide open.

Each of first partial gear pinion member 46, second partial gear member 56 and latch member 64 are biased by springs 100, 102 and 104, respectively, so as to rest in the position the in which the components are illustrated in FIG. 6. Thus, in operation, after the door handle is released, the springs will urge the components back to their resting state, causing the handle to move in the reverse direction of arc 90, to the resting state.

Referring back to FIG. 4, at the same time that the above-mentioned operational steps are occurring, rotation of the second partial gear member 56 will result in movement of pin 68 upwardly in the direction of arrow 106, which causes actuator bar 70 to also move upwardly in that direction. This upward movement pulls pin 72 up also, which raises up the end of cam 76 having slot 74 therein, causing cam 78 to pivot about shaft 78, as illustrated by arc 108. Now, the lower end of the cam having shaft 80 moves forward, and the pinned engagement of actuator bar 84 to the cam by pin 82 urges actuator bar 84 to move outwardly in the direction of arrow 110 along the axis 88. This outward movement will push actuator bar 84 against a strike plate mounted in the wall frame, which assists in opening the door by pushing outwardly away from the wall frame. Since the actuator bar is mounted near the bottom of the door, the outward pushing assists in smooth, non-binding opening of the door.

Figure 5:
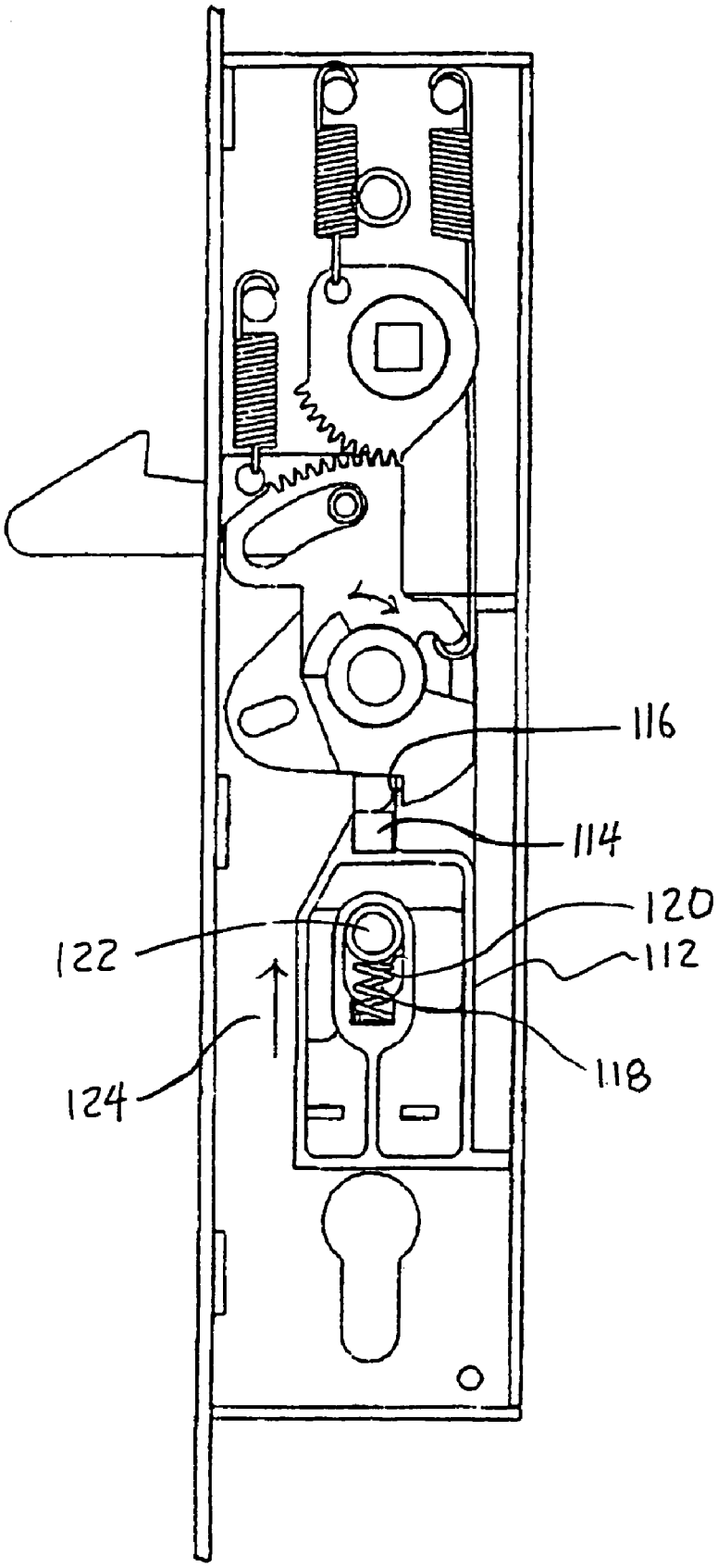
FIG. 5 is an enlarged cut away view of the upper portion of operative components of the gliding door latch according to the invention.

Referring now to FIG. 5, an enlarged cut away view of the upper portion of operative components of the gliding door latch, the locking mechanism thereof may be better understood. Mounted below second partial gear member 56 is a lock slide member 112, which carries a substantially solid rectangular block member 114 at an upper end thereof. A catch 116 is defined at the lower end of second partial gear member 56, complementarily shaped to the block member 114. A central elongate aperture 120 is defined in the lock slide 112, and has a spring 118 therein which pushes against a pin 122 at the top end of the elongate aperture 120.

In operation, to lock the door latch, the lock slide member is moved upwardly (by movement of pin 122) in the direction of arrow 124. The rectangular block member 114 engages with the corresponding portion 116 of partial gear member 56, blocking the gear member from movement, which prevents operation of the latch, thereby locking the door.

Figure 7:
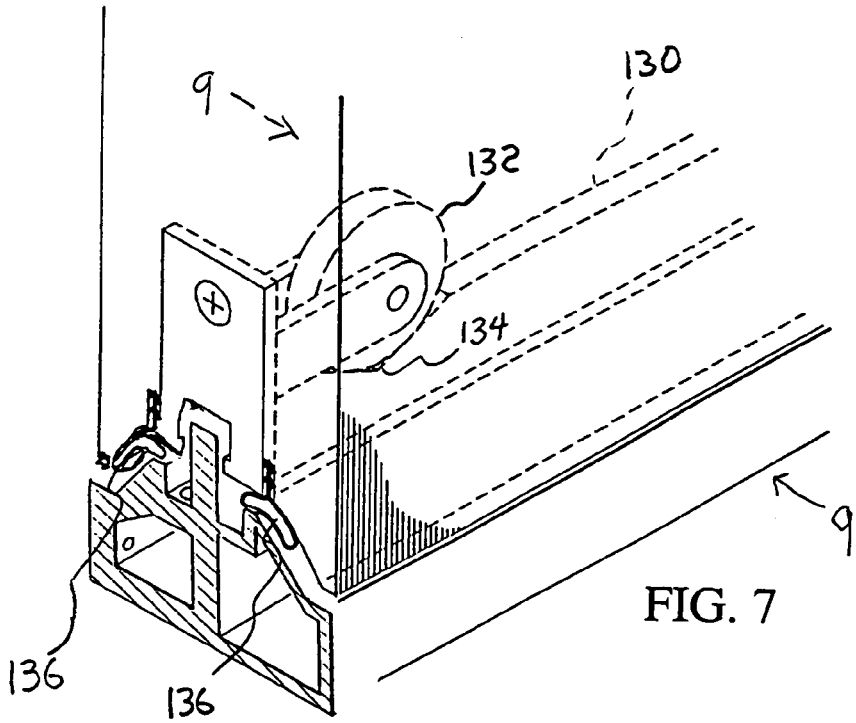
FIG. 7 is a partial transparent partial sectional view of a roller wheel of a gliding door, with the door in the closed position.

Referring now to FIG. 7, which is a partial transparent partial sectional view of a roller wheel of a gliding door, with the door in the closed position, the door suitably rides along a track 130 by means of a wheel 132 positioned along the underneath of the door. The track includes a seat portion 134 which is slightly lower than the rest of the track. Along one or more bottom portions of the door are flexible seal members 136. Thus, when the door is in a closed position, the wheel rides down into the seat, which lowers the door slightly, compressing the seal members against a portion of the track structure. A weather tight seal is thereby provided.

However, when the door is to be opened, it is desirable that the seals not be compressed or otherwise engaged. Therefore, referring to FIG. 8, a partial transparent partial sectional view of the gliding door of FIG. 7, with the door in an open position, as the door is slid open, the wheel rides up out of the seat portion 134, onto the main elevated portion 130 of the track. This lifts the door sufficiently to raise the seals from engagement with the track, allowing easy gliding of the door and reducing wear on the seals.

Figure 8:
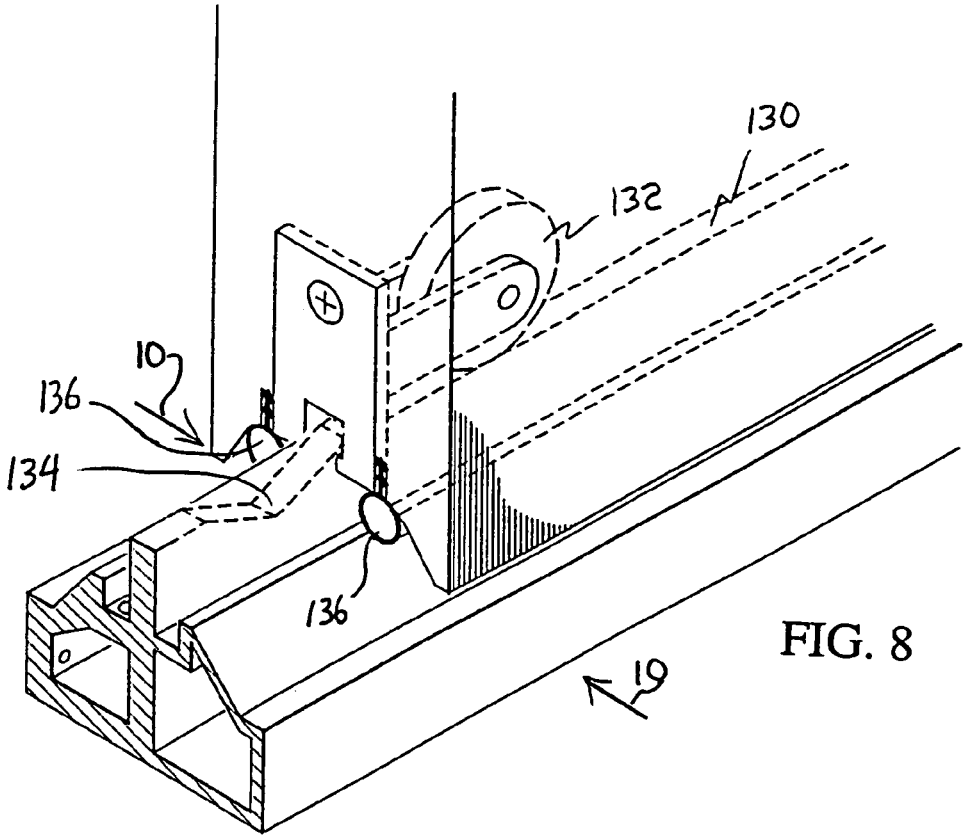
FIG. 8 is a partial transparent partial sectional view of the gliding door of FIG. 7, with the door in an open position.
Figure 10:
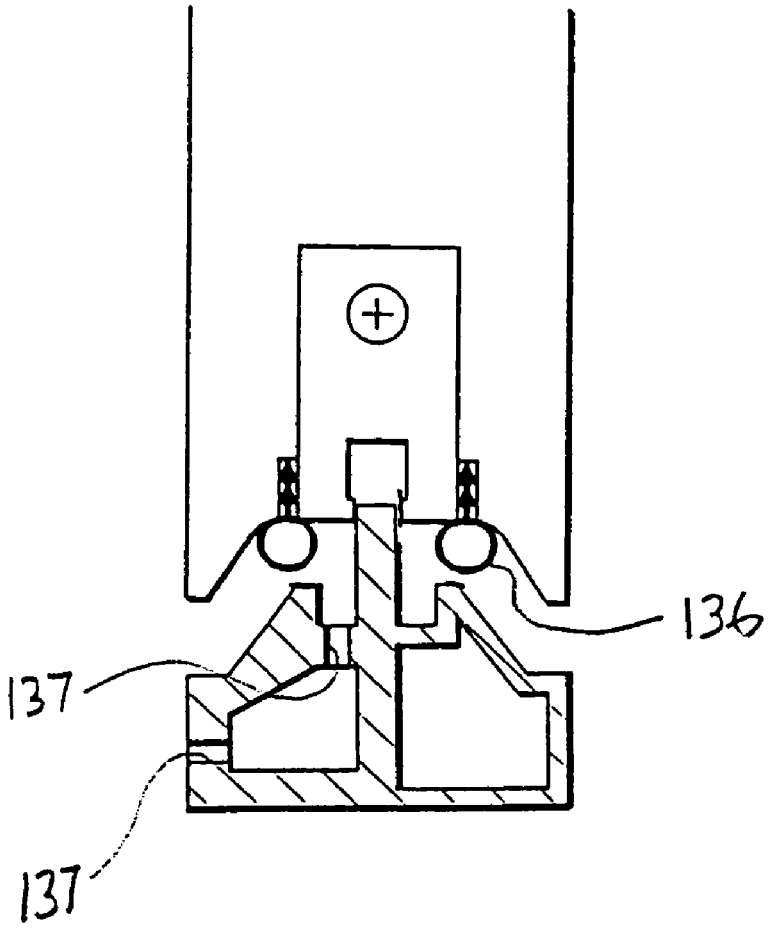
FIG. 10 is a partial sectional/end view of the gliding door when in an open position, illustrating the state of the seals.
Figure 9:
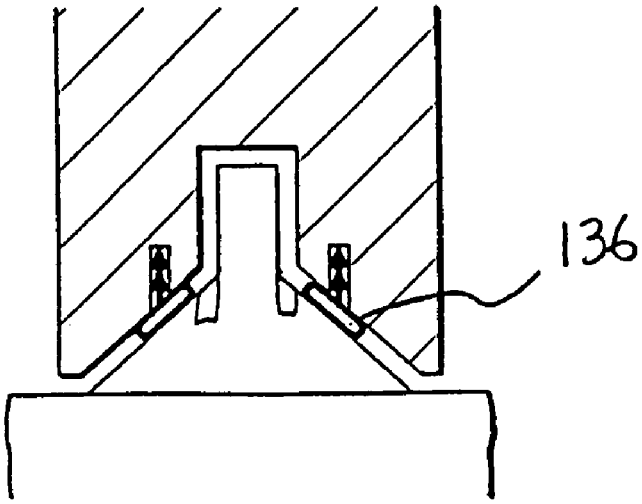
FIG. 9 is a partial sectional view taken along line 9-9 of FIG. 7, illustrating the sealing of the door.

FIG. 9 is a partial sectional view taken along line 9-9 of FIG. 7, illustrating the seals and the door when the seals are compressed, while FIG. 10 is a partial sectional/end view of the gliding door taken along line 10-10 of FIG. 8, illustrating the seals when the door is in an open position. It may be noted that the lower rail/frame portion of the door system includes drain holes 137 on one side of the frame, suitably being oriented towards the outside, to allow draining to the outside of any water that might collect. Note that when the door is open, the seals are free from engagement with the frame, allowing a very easy gliding of the door.

The operation of the door latch, and more particularly to function of actuator bar 84, assists in moving the door out of the seat when the process of opening first begins. The actuator bar makes opening the door relatively easy, and the gears enable substantial opening force to be generated, without requiring a substantial amount of strength on the part of the user moving the handle.

Figure 11:
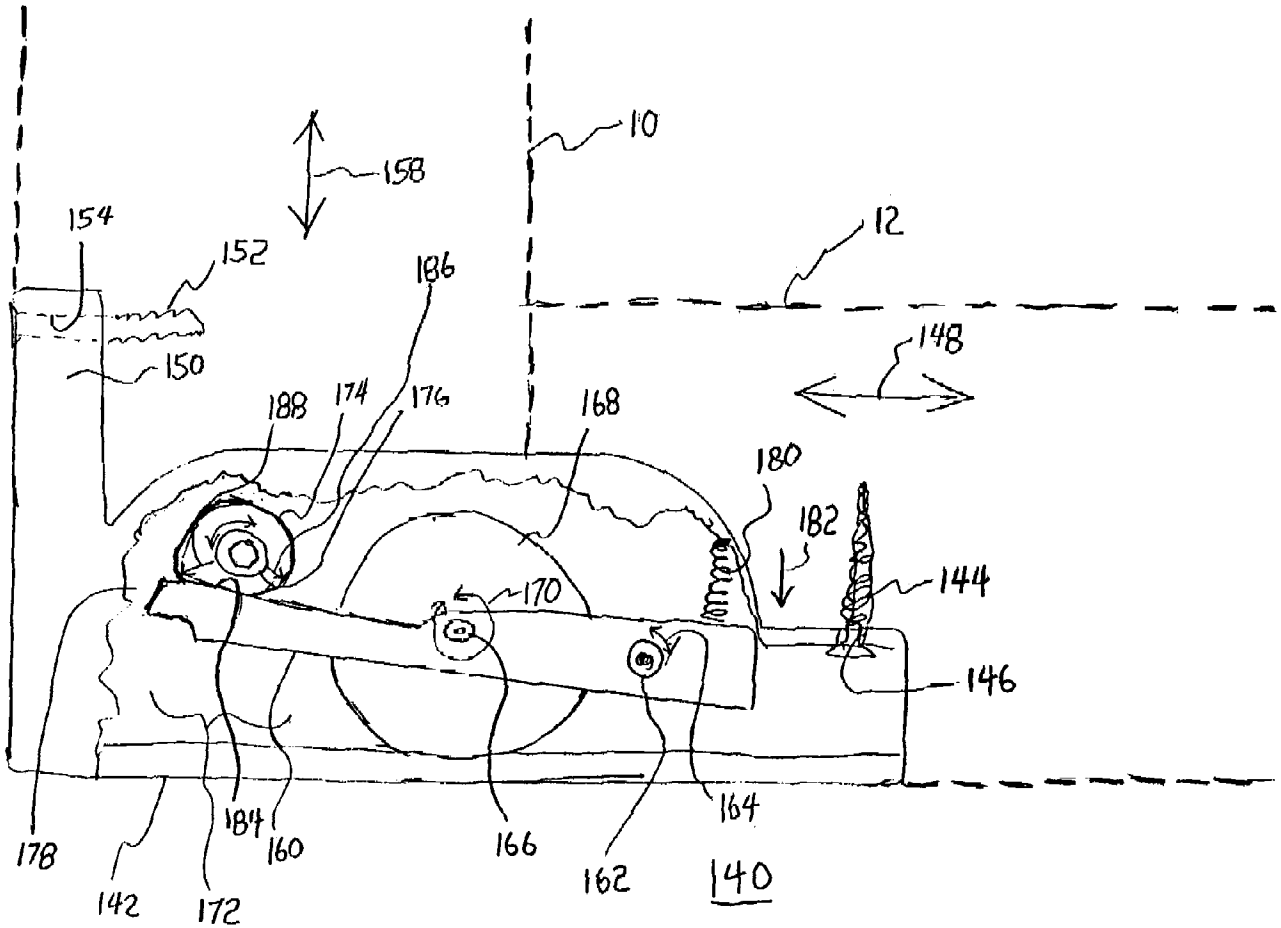
FIG. 11 is a partially transparent side view of a preferred embodiment of the wheel mechanism of the sliding door.

While a representative wheel 132 is illustrated in FIGS. 7 and 8, a preferred wheel assembly is shown, referring to FIG. 11, a partially transparent side view of a preferred embodiment of the wheel mechanism 140 of the sliding door. The mechanism includes a frame 142, which mounts against both the stile 10 and the rail 12 of the door, at the lower corners thereof where the stile and rail meet. At the end of the frame where the rail is engaged, a fastener 144, which comprises a screw in the illustrated embodiment, is received through a rail fastener opening 146, and engages the rail across the rail's grain direction 148. At the other end of the frame 142, is a vertically oriented member 150 which extends some distance up along the stile 12 of the door. Fastener 152, suitably a screw, is received through upper fastener hole 154, oriented to receive the fasteners across the grain of the door stile 10. The grain direction of the stile is indicated by arrow 158.

Within the central portion of the frame 142, an elongate wheel supporting arm 160 is pivotally attached to the frame by pivot pin 162 near a first end of the arm, so as to allow some pivotal movement about the pin 162 as indicated by arc 164. Approximately centrally of the arm 162 is an axle member 166, which rotationally supports a wheel 168 thereon, for allowing rotation of the wheel about the axle around rotation lines 170. Wheel 168 suitably is flat in cross section on its rolling surface, rather than being crowned. Extending beyond the position of wheel 168 is the outward extent portion 172 of the arm, which has a flat upper surface. Mounted above the arm is a cam member 174, carried on a hex keyed axle 176, for enabling movement of the cam about the axis of the axle, indicated by arc 178. The cam suitably has a long flat portion 184, resting against the top of the arm 160 in the illustration, and has a number of flat segments defined about the outer periphery thereof. In a preferred embodiment, there are ten such segments, not counting the portion 184. The flat segments are progressively farther out radially from the center of the axle, such that, for example, the distance from the axle to the outer edge of a flat segment at 186 is less than the distance from the axle to the outer edge of the flat segment at 188.

At the end of arm 160 opposite of the location of the cam, a spring 180 is mounted within the frame 142, and pushes downwardly in the direction of arrow 182, urging the end of the arm on the right in the drawing downwardly, and correspondingly urging the opposite end of the arm 160 upwardly.

In operation, the wheel mechanism 140 is positioned within a correspondingly shaped opening in the stile and rail of the door. The screw fasteners 144 and 152 are secured into the stile and rail, and the hex keyed axle 176 is rotated clockwise by use of a hex wrench so as to cause different ones of the flat segment portions of the cam to come into contact with the top of arm portion 172. As the cam is further rotated clockwise, the corresponding flat segments contacting the arm are positioned farther out radially on the cam from the center of the axle, and therefore the arm is urged further downwardly against the action of the spring 180 with successive turning of the cam, lowering the wheel 168 further. Thus, the position of the wheel is suitably raised or lowered, to provide adjustment so that the wheel rides properly on its rail by turning the cam about its axle. Once the wheel is set at a desired adjustment position, the cooperation of the flat segment of the cam with the flat top of the arm, in conjunction with the bias provided by the spring, maintains the wheel in the desired adjustment position, so that it is unlikely to move from its adjusted position. The cross grain engagement of the screws provides a secure attachment of the wheel to the door, both at the rail and the stile, while enabling the wheel to be positioned very near the outer edge of the door.

Figure 12:
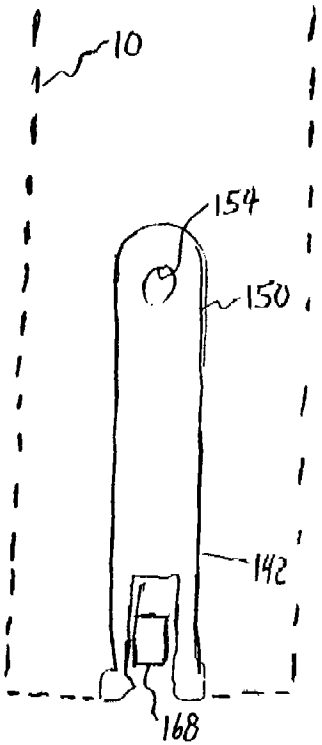
FIG. 12 is an end view of the wheel mechanism of FIG. 11.

FIG. 12 is an end view of a door stile 10 (in phantom) showing a typical mounting position of the mechanism 140.

Referring now to FIGS. 13-17, which are sectional views of a gliding door according to a preferred embodiment, the moving door panel 190 carries an inverted L shape member 192 that extends up the vertical side of the door opposite the lock and across the top of the door. On the non-moving panel 194, a corresponding U shaped channel 196 is provided, having a closed cell foam seal member 198 along the bottom of the channel. The closed cell foam seal member 198 is substantially rectangular in cross-section, with a hollow interior and plural finger like members on the surface thereof oriented toward member 192. A similar closed cell foam seal member 200 is positioned along the bottom of the door and up the side of the door immediately adjacent the latch side thereof. At the bottom of the door a weather guard member 202, which may includes drain holes 204 therein, is provided. When the door is in the closed position, as shown in FIG. 13, the member 192 seals against seal 198, while the weather guard seals against seal 200. When the door is opened, however, as shown in FIG. 14, both seals are free from engagement with their corresponding sealing surfaces, enabling the door to easily slide. The open/closed height difference on the door is suitably about $5/16^{th}$ of an inch. FIG. 13 illustrates the sectional view looking in the direction of arrow 17 of FIG. 2, with the door closed, while FIG. 14 is the sectional view through the doors looking in the direction of arrow 15 of FIG. 3, when the door is open.

Figure 15:
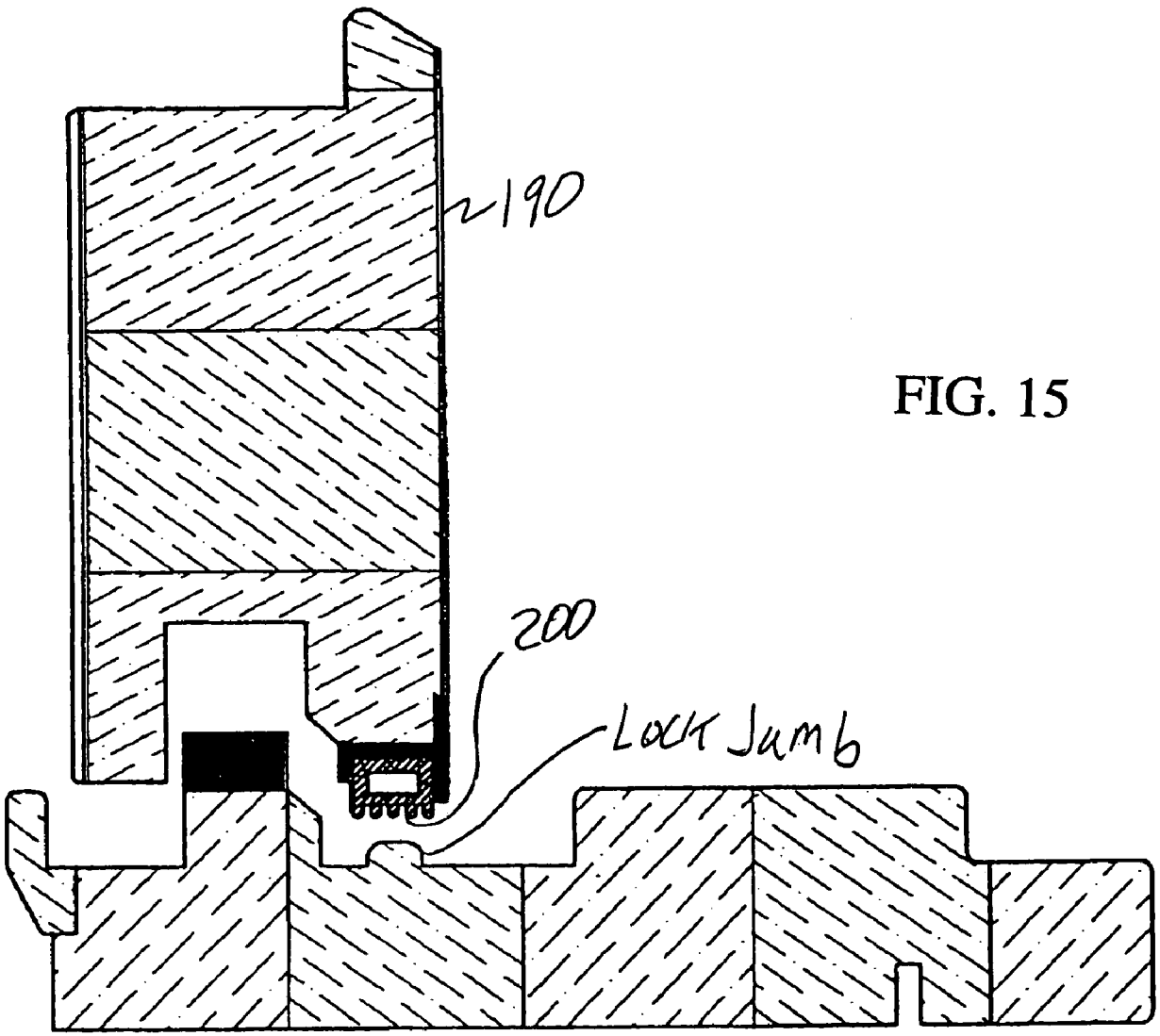
FIG. 15 is a sectional view of the lock jamb region of the door of FIG. 13.
Figure 16:
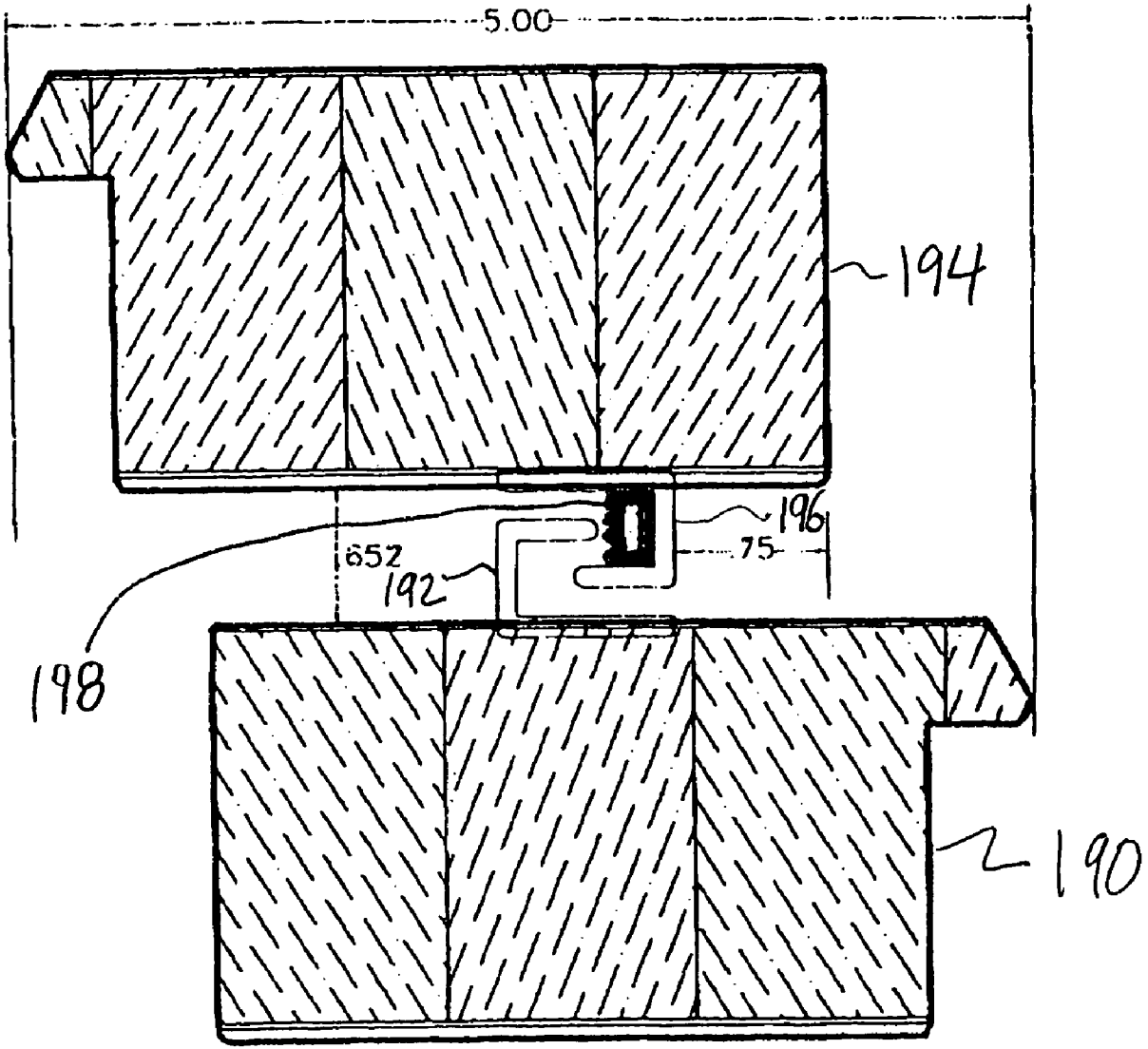
FIG. 16 is a sectional view of the interlocking stiles of the door of FIG. 13.

FIG. 16 illustrates a downward looking view in the direction of arrow 19 of FIG. 2, in the region of the interlocking stiles, with the door just slightly opened. FIG. 15 illustrates a sectional view of the sealing in the region of the lock jamb, looking down along arrow 13 of FIG. 2.

Figure 17:
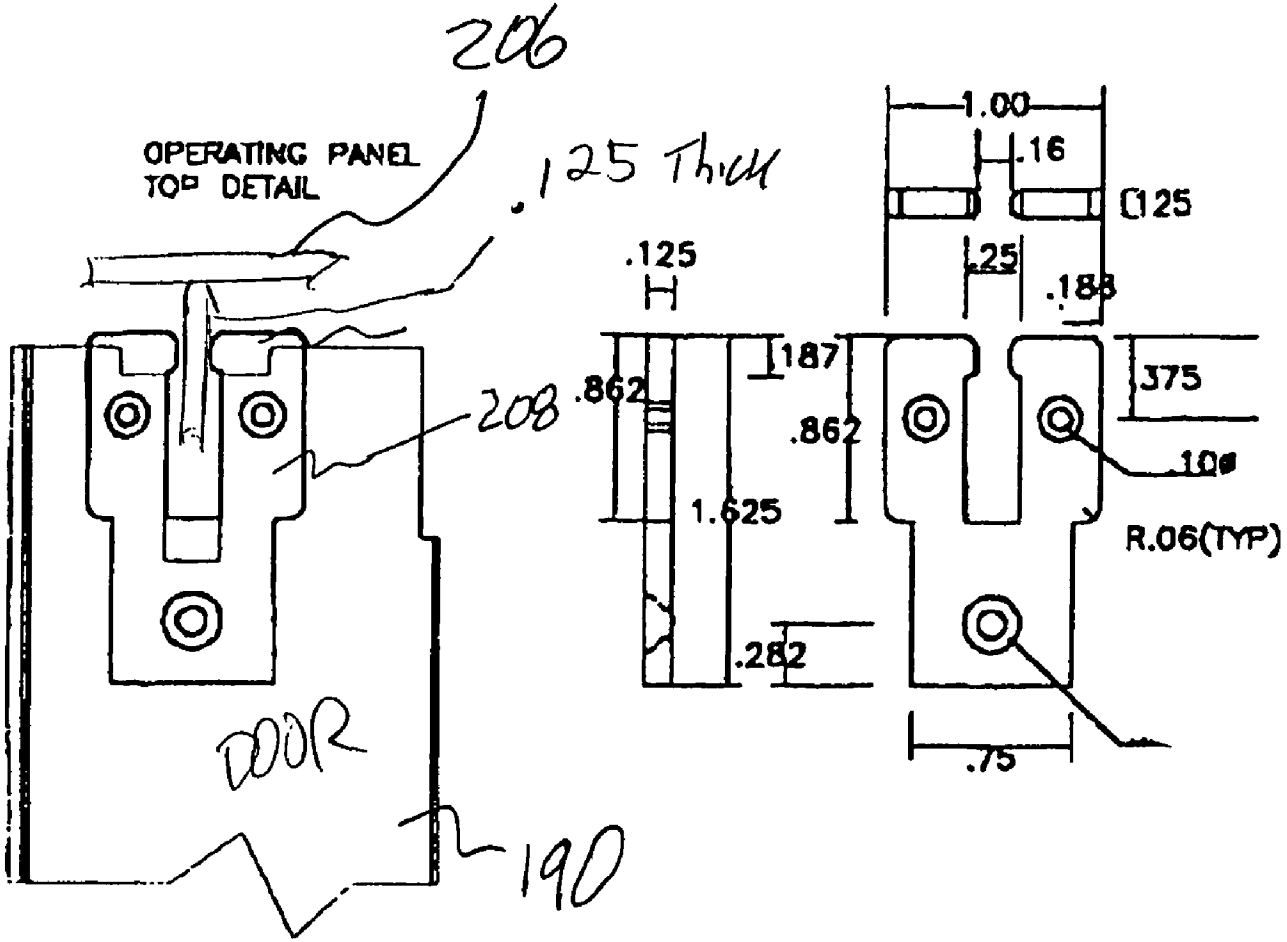
FIG. 17 is a view of the upper guide of the door of FIG. 13.

FIG. 17 is a view of the upper guide of the door of FIG. 13. A T-track guide 206 is provided along the frame of the building at the top of the moving door panel. The leg portion of the "T" extends down into a door upper guide 208. Bumpers 210 ride along the T leg, providing a sliding engagement between the track and door, while keeping the door from shifting laterally back and forth. The bumpers are suitably a propylene or high molecular weight plastic to provide easy gliding. Suitably one door upper guide is provided at each of the upper edges of the door.

In the preferred embodiment, the door latch and wheel mechanisms are substantially of metal, other than the wheel, which is a relatively hard polymer. The gear reduction provided by the gears enables easy opening of the door with little effort.

Accordingly, according to the invention, even heavy vinyl or wood doors are easily opened and closed. Since the door according to the invention is only sealed when the wheels ride down into the recess, the door easily glides when open, and the seals last a long time and are effective.

While plural embodiments of the present invention have been shown and described, it will be apparent to those skilled in the art that many changes and modifications may be made without departing from the invention in its broader aspects. The appended claims are therefore intended to cover all such changes and modifications as fall within the true spirit and scope of the invention.

The invention claimed is:

1. A gliding door latch mechanism, comprising:

a handle operatively connected to a latch member for latching and unlatching the gliding door;

a gear reduction mechanism operatively cooperating with said handle; and a lower door opening push member cooperatively acting with the handle to assist in pushing the door open in concert with unlatching of the door by operation of the handle, further comprising an elongate actuator member drivingly engaged by operation of said handle to move said actuator member in a substantially vertical direction, and wherein said lower door opening push member is drivingly engaged with said elongate actuator member to move in said substantially horizontal direction.

2. A gliding door latch mechanism, comprising:

a handle operatively connected to a latch member for latching and unlatching the gliding door;

a gear reduction mechanism operatively cooperating with said handle; and a lower door opening push member cooperatively acting with the handle to assist in pushing the door open in concert with unlatching of the door by operation of the handle, further comprising a cam member operatively engaged with said actuator member and said lower door opening push member, for converting substantially vertical direction movement of said actuator member to substantially horizontal direction movement of said lower door opening push member.

3. A gliding door latch mechanism according to claim 2, wherein said cam member comprises a rotational axis and a portion engaging said actuator member to cause rotation of said cam in response to movement of said actuator member, and said cam further comprises a portion engaging said lower door opening push member, whereby rotational movement of said cam causes substantially horizontal direction movement of said push member.

4. A latch and opening mechanism for a gliding door, comprising:

a latch member operatively connected with a handle for latching and unlatching of said latch member with a latching receiving portion in response to operation of said handle; and a handle movement transmission system for transmitting unlatching movement of said handle to a door opening assist member, for causing door opening assist movement of said assist member as a result of unlatching operation of said handle, wherein said handle transmission system comprises a gear reduction member operatively engaged with said handle and an actuator bar driven by said gear reduction member for translating movement of said handle to substantially linear movement of said actuator bar, further comprising a cam system operatively connecting said actuator bar and said door opening assist member, for translating the movement of said actuator bar into movement of said door opening assist member in a different direction than the movement of said actuator bar.

5. A latch and opening mechanism for a gliding door, comprising:

a latch member operatively connected with a handle for latching and unlatching of said latch member with a latching receiving portion in response to operation of said handle; and a handle movement transmission system for transmitting unlatching movement of said handle to a door opening assist member, for causing door opening assist movement of said assist member as a result of unlatching operation of said handle, wherein said handle transmission system comprises a gear reduction member operatively engaged with said handle and an actuator bar driven by said gear reduction member for translating movement of said handle to substantially linear movement of said actuator bar, wherein said actuator bar moves in a substantially vertical direction and said door opening assist member moves in a substantially horizontal direction.

6. A gliding door latch system, comprising:

a handle in a door, adapted for rotational movement;

a first partial gear pinion member operatively cooperating with said handle to rotate in conjunction with rotational movement of said handle;

a second partial gear member engaging with said first partial gear member, whereby rotation of said first partial gear member causes rotation of said second partial gear member, said second partial gear comprising a first and second slot therein;

a latch member having a pin attached thereto, said pin riding in said first slot, wherein as a result of the attachment of the pin to said latch member, said latch member moves as a result of movement of said handle;

an actuator bar having a first pin member at a first position thereof riding in said second slot, wherein rotation of the second partial gear member result in movement of said actuator bar pin which causes actuator bar to also move upwardly in that direction, said actuator bar further having a second pin member at a second position distal from said first position, a cam engaged by said second pin member, said cam adapted for rotational movement with linear movement of said actuator bar;

a door opening assist member engaged by said cam, wherein movement of said cam urges said door opening assist member to move outwardly away from a body of the door to assist in pushing said door from a closed position to start an opening movement thereof.

7. The gliding door latch system according to claim 6, wherein said door opening assist member is slidingly mounted to enable movement of the actuator bar inwardly and outwardly of the door.

8. The gliding door latch system according to claim 6, further comprising a latch member operatively cooperating with said handle for unlatching movement when said handle is operated in a direction.

* * * * *